US009452309B2

(12) United States Patent
Scaramucci

(10) Patent No.: US 9,452,309 B2
(45) Date of Patent: Sep. 27, 2016

(54) MODULAR STRUCTURE FOR GYM OR SIMILAR AND EXERCISE APPARATUS INCLUDING THIS STRUCTURE

(75) Inventor: Silvia Scaramucci, Milan (IT)

(73) Assignee: Amer Sports Italia S.P.A., Battaglia (IT)

( * ) Notice: Subject to any disclaimer, the term of this patent is extended or adjusted under 35 U.S.C. 154(b) by 242 days.

(21) Appl. No.: 14/110,969

(22) PCT Filed: Apr. 13, 2012

(86) PCT No.: PCT/IB2012/051845

§ 371 (c)(1),
(2), (4) Date: Nov. 15, 2013

(87) PCT Pub. No.: WO2012/140622

PCT Pub. Date: Oct. 18, 2012

(65) Prior Publication Data

US 2014/0054247 A1 Feb. 27, 2014

(30) Foreign Application Priority Data

Apr. 13, 2011 (IT) ..... MI20110126 U

(51) Int. Cl.

| | |
|---|---|
| ***A63B 21/16*** | (2006.01) |
| ***A63B 17/04*** | (2006.01) |
| ***A63B 1/00*** | (2006.01) |
| ***A63B 9/00*** | (2006.01) |
| ***A63B 71/04*** | (2006.01) |
| *A63B 21/04* | (2006.01) |
| *A63B 21/055* | (2006.01) |

(52) U.S. Cl.

CPC ..... *A63B 17/04* (2013.01); *A63B 1/005* (2013.01); *A63B 9/00* (2013.01); *A63B 21/16* (2013.01); *A63B 71/04* (2013.01); *A63B 21/0442* (2013.01); *A63B 21/0552* (2013.01); *A63B 2210/50* (2013.01)

(58) Field of Classification Search

CPC ..... A63B 69/201; A63B 1/00; A63B 1/005; A63B 17/00; A63B 17/02; A63B 17/04; A63B 21/16; E04B 2001/405

See application file for complete search history.

(56) References Cited

U.S. PATENT DOCUMENTS

| | | | | |
|---|---|---|---|---|
| 2,365,117 | A | 12/1944 | Stafford et al. | |
| 3,353,854 | A * | 11/1967 | Hansen | 403/171 |
| 6,348,028 | B1 * | 2/2002 | Cragg | 482/148 |
| 7,066,866 | B1 * | 6/2006 | Mobley | 482/40 |
| 8,177,694 | B1 * | 5/2012 | Walker | 482/126 |
| 2007/0032357 | A1 * | 2/2007 | Piane, Jr. | 482/142 |

FOREIGN PATENT DOCUMENTS

| | | |
|---|---|---|
| BE | 821 798 | 3/1975 |
| DE | 20 2005 014583 | 11/2005 |
| FR | 2 581 553 | 11/1986 |
| GB | 933 812 | 8/1963 |

OTHER PUBLICATIONS

International Search Report dated Sep. 27, 2012, corresponding to PCT/IB2012/051845.

* cited by examiner

*Primary Examiner* — Loan H Thanh
*Assistant Examiner* — Rae Fischer
(74) *Attorney, Agent, or Firm* — Young & Thompson; Terence P. O'Brien

(57) ABSTRACT

A modular structure for gymnasiums or similar, includes at least one pair of supports (2) for positioning near facing walls of a room, a beam (4, 30, 60) connected at its ends (4*a*) to the supports, the supports being provided with connection elements (6) configured to be shifted from a tightened position in which they make the beam (4, 30, 60) integral with the supports (2), to a released position in which they allow the beam (4, 30, 60) to translate with respect to the supports (2), connection elements (10) for exercise equipment being provided on the beam (4, 30, 60), the elements being configured to translate along the beam (4, 30, 60).

20 Claims, 12 Drawing Sheets

MODULAR STRUCTURE FOR GYM OR SIMILAR AND EXERCISE APPARATUS INCLUDING THIS STRUCTURE

BACKGROUND

The present innovation concerns a modular structure for gym or similar and more specifically a modular structure for installation in a gymnasium to provide a multi-function exercise apparatus.

The invention is conceived to solve the problems of lack of space in gymnasiums, clubs and similar, and at the same time allow a wide range of gym and motor exercises to be performed.

A problem that is increasingly felt in the fitness sector, and more specifically in gymnasiums, clubs and sports centres (and also in motor rehabilitation centres), is that of providing users with an increasingly wide range of gym and motor activities from which they can choose and practise the ones they prefer.

Generally these centres comprise an area equipped with fixed machines where pre-set exercises are performed, and an area comprising one or more rooms where floor exercises and other gymnastic activities can be performed.

Many of these activities, however, even the simplest ones, require a minimum of equipment and an adequate space configured for use of the above-mentioned equipment.

The high number of gymnastic activities (courses) offered in each gymnasium or centre means that it is not possible to dedicate a room or a space to each activity.

For this reason any equipment has to be arranged on the floor or on the walls before beginning the activity or the course and removed at the end of it.

In particular it is important for the floor of the premises to be completely clear, i.e. without fixed or non-removable installations, to allow performance of activities in which the persons move more or less freely inside the room, for example step, aerobics or similar.

Some of these activities, for example functional training, suspension training, TRX and similar, which are currently very popular, require equipment for performance of the exercises such as elastic bands, ropes, straps or similar for anchoring to the ceiling of the room.

For this purpose trestle and frame structures or similar are known which are fixed to the ceiling and/or the walls of the room, to which this equipment is connected.

These structures of known type, in addition to allowing the practice of a limited range of exercises, for example only with elastic bands, ropes, straps or similar, also have further drawbacks.

Said structures are designed ad hoc for the spaces of a given room and are set up in situ by several operators having not only carpentry skills for assembly of the various components, but also including bricklayers to perform the masonry work necessary for supporting the structure.

The provision of said structures according to the known technique therefore requires time, in some cases even several days, and entails considerable production costs.

Furthermore structures of this type, since they are sized ad hoc for a given space, are difficult and even impossible to remove, for example for repositioning in another room of the gymnasium or centre.

In this context, the object of the present innovation is to propose a modular structure for gymnasiums or similar, which overcomes the drawbacks of the known art.

In detail, the object of the innovation is to propose a modular structure for gymnasiums which can be installed in any room rapidly and simply without the need for highly skilled personnel.

More specifically, it is the object of the present innovation to propose a modular structure for gymnasiums or similar, consisting of standardised elements which can be easily assembled and which allow a reduction in production costs.

A further aim of the present innovation is to propose a modular structure for gymnasiums or similar, which provides a multi-function exercise apparatus that can be configured for a wide range of gymnastic and motor activities, without reducing the space available on the floor of the premises.

In further detail, the object of the present invention is to propose a modular structure for gymnasiums or similar which exploits the surface of the ceiling and walls for positioning the equipment necessary to perform the above-mentioned gymnastic and motor activities.

The above-mentioned objects are substantially achieved by a modular structure for gymnasiums and similar, comprising at least one pair of supports to be positioned near the facing walls of a room and a beam connected at its ends to said supports in which said supports are provided with connection means configured to be shifted from a tightened position in which said beam is made integral with the supports, to a released position in which said beam is free to translate with respect to said supports; connection means for gymnastic equipment are also provided on said beam, configured to translate along said beam.

Said supports can be mounted at the upper ends of a pair of columns, or can be provided with means for fixing to the walls of the room.

The modular structure configured as above allows easy rapid installation in the room of a gymnasium or similar also by unskilled personnel and without the need for masonry work.

In detail said supports comprise a bracket with respect to which the beam can translate from a position of maximum support, in which the end of the beam completely overlaps the bracket, to a position of minimum support, in which the beam overlaps the bracket for a portion having a length which allows the beam to be sustained.

In this way, by varying the position of the beam on the supports it is possible to use a limited set of beams of different length to adapt the modular structure to rooms of any size.

The structure configured in this way also allows repositioning if necessary in another place with different dimensions, replacing only the beams.

BRIEF DESCRIPTION OF THE DRAWINGS

Further characteristics and advantages will become clearer in the indicative and therefore non-limiting description of an example of preferred but non-exclusive embodiment of the innovation, as illustrated in the accompanying figures in which.

DETAILED DESCRIPTION OF THE INVENTION

Figure 1:
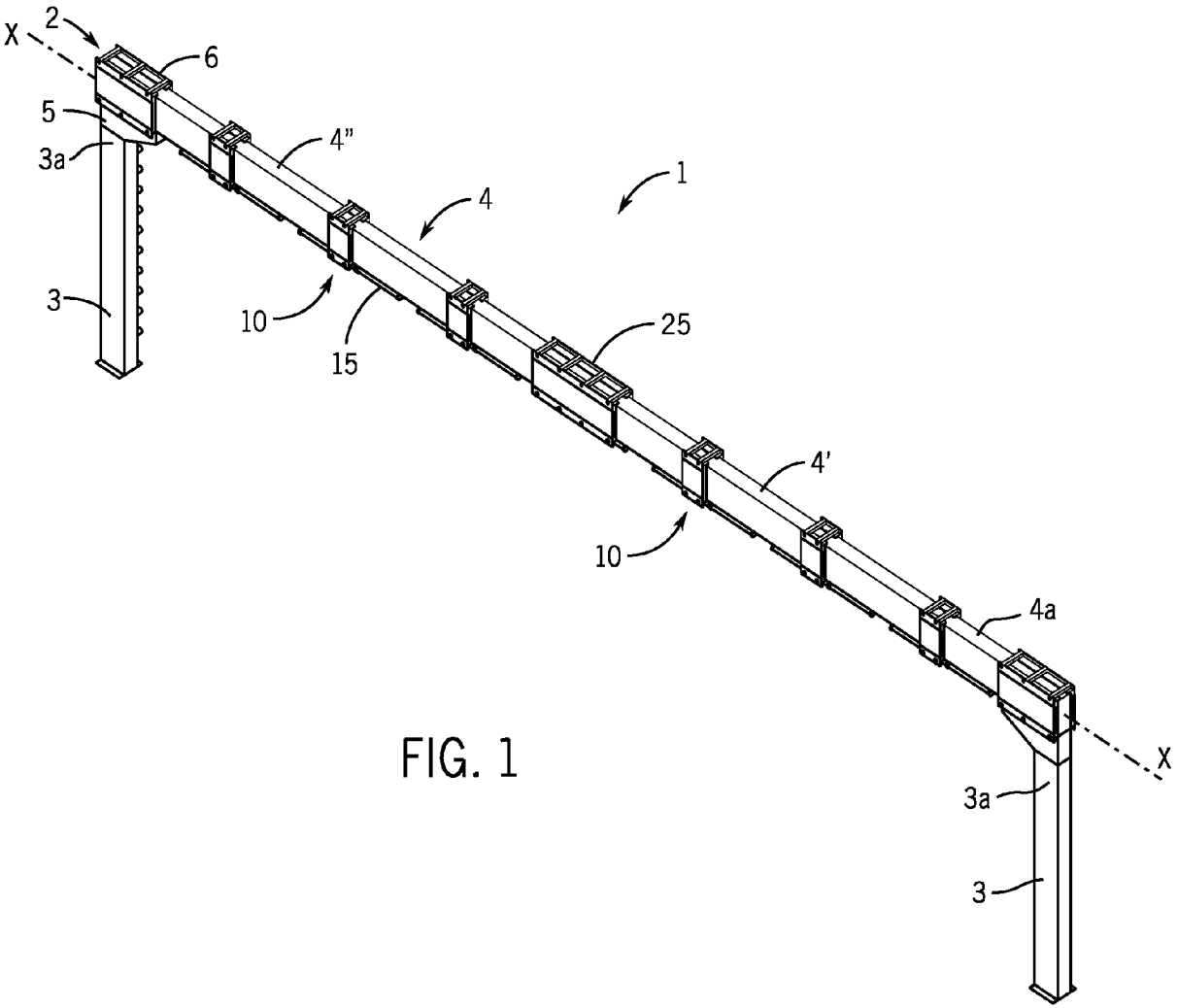
FIG. 1 is a perspective view of the modular structure for gymnasiums, according to a first embodiment of the innovation.
Figure 2:
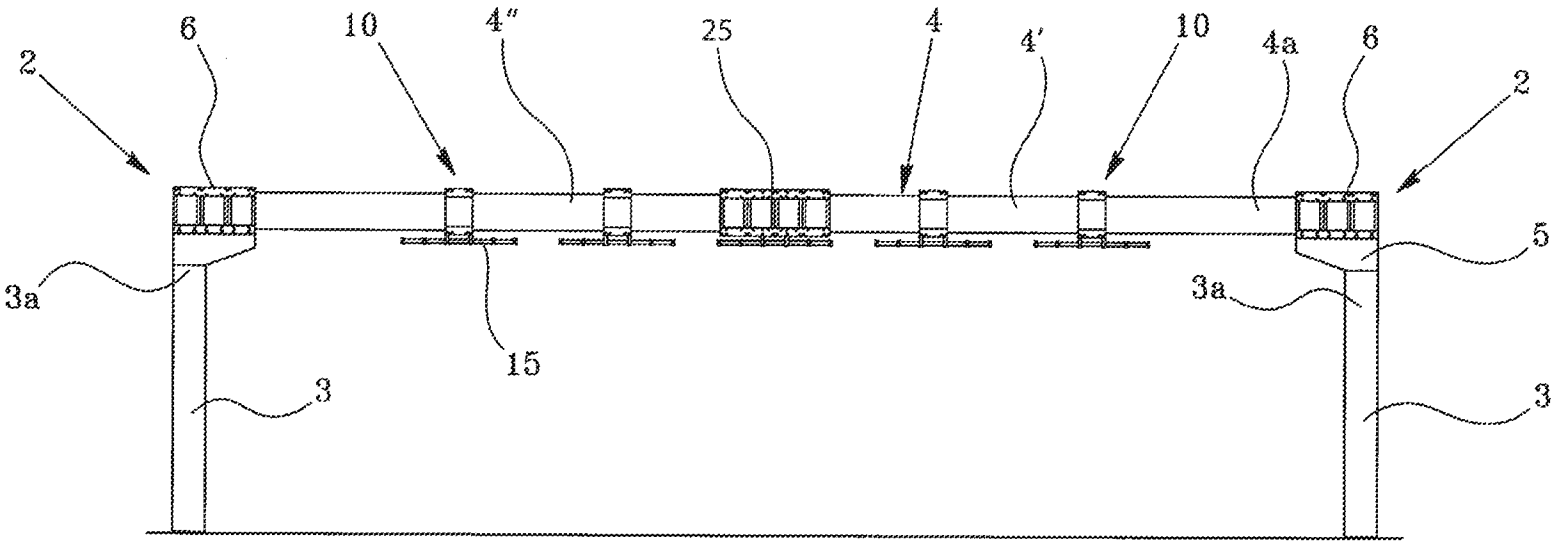
FIG. 2 is a front view of the modular structure of FIG. 1.

With reference to the accompanying figures the modular structure for gymnasiums indicated overall by 1 comprises a pair of supports 2 for positioning near two facing walls of a room of a gymnasium, a club, a sports centre or similar.

According to a first embodiment of the innovation, said supports 2 are mounted at the upper ends 3*a* of the same number of columns 3, preferably close to the walls of said room.

To guarantee stability, said columns 3, are provided at the base with means (not illustrated in the figure) for fixing to the floor of the gymnasium or similar.

A beam, indicated overall by 4, is connected at its ends 4*a* to said supports 2 forming with the columns 3 a substantially arc-shaped structure.

According to a first embodiment, said beam substantially comprises a box-type element with polygonal section, preferably with rectangular section, preferably made of steel, like the other elements of the structure.

In the embodiment illustrated, said supports comprise a bracket 5 on which one end 4*a* of the beam 4 rests. In practice, a portion of each end 4*a* of the beam overlaps the bracket 5 so that it is supported. Furthermore the supports are provided with connection means, indicated overall by 6, to make said beam integral with said supports.

According to the innovation, said connection means 6 are configured to be shifted from a tightened position in which they prevent translation of the beam 4 with respect to the support 2, to a released position in which they allow said beam to translate with respect to said support, or with respect to the bracket 5.

In practice, it is possible to translate the beam 4 along its main axis, indicated by X in the figure, varying the length of the overlapping portion of the beam 4 and the bracket 5 of the support 2.

Figure 3B:
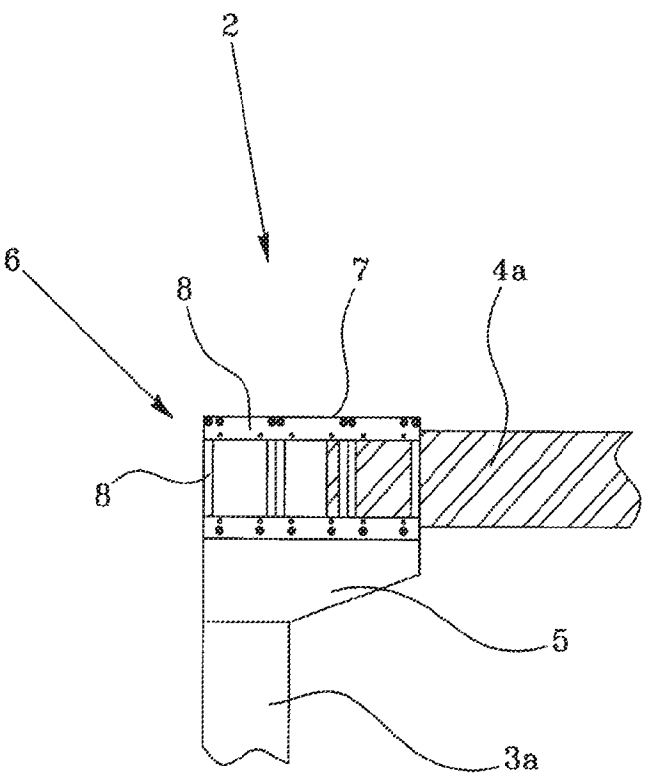
FIGS. 3*a* and 3*b* are two front views of the connection means of the beam to the support, in two operating positions respectively.

More specifically, said beam 4 can translate in relation to the support 2 from a position of maximum support, in which the end 4*a* of the beam completely overlaps the bracket 5 (FIG. 3*a*), to a position of minimum support, in which the beam overlaps the bracket for a portion having a length which allows the beam to be sustained (FIG. 3*b*).

The modular structure thus configured therefore allows adaptation to the dimensions of the room using a set of standardised beams of pre-determined lengths.

In particular with this system it is always possible to install the structure maintaining the columns 3 always adjacent to two facing walls of the room, minimising occupation of the working surface.

For example if the distance between the two facing walls of the room is equal to X meters, it is possible to create the modular structure using a beam, chosen from the standard beams, slightly shorter than said length of X meters, recovering the difference thanks to the possibility of varying the position of the beam 4 between the position of maximum support and minimum support.

Advantageously, to reduce the maximum dimension of the elements of the modular structure for transport, said beam 4 can consist of two or more portions 4' and 4" positioned consecutively and connected by couplings 25.

In this case said portions of beam 4' and 4" will be chosen from the standard beams so that the sum of their length is slightly less than the distance of X meters between the walls of the room.

In this way with a limited number of standardised beams of different lengths, it is possible to create structures for rooms of any size.

During assembly of the modular structure the connection means 6 of the beam 4 to the support 2 are kept in the released position to allow exact positioning.

Once the beam is correctly positioned on the two supports, said connection means 6 are shifted from the released position to the tightened position to make the beam 4 integral with the supports 2.

According to a first embodiment illustrated in FIG. 3, said connection means 6 comprise a trestle structure fixed integral with the bracket 5.

In one implementation, said trestle structure 7 comprises a plurality of structural pieces 8 interconnected by screws 9 or similar connection means.

By loosening and tightening said connection screws 9 it is possible to shift the trestle structure 7 from the tightened position to the released position and vice versa.

The beam 4 is furthermore provided with connection means, indicated overall by 10, for the connection of exercise equipment such as elastic bands, ropes, straps, punching bags and other similar equipment of known type.

According to a first embodiment illustrated in FIG. 4, said connection means 10 comprise a trestle element 11 arranged around the beam 4.

Figure 4B:
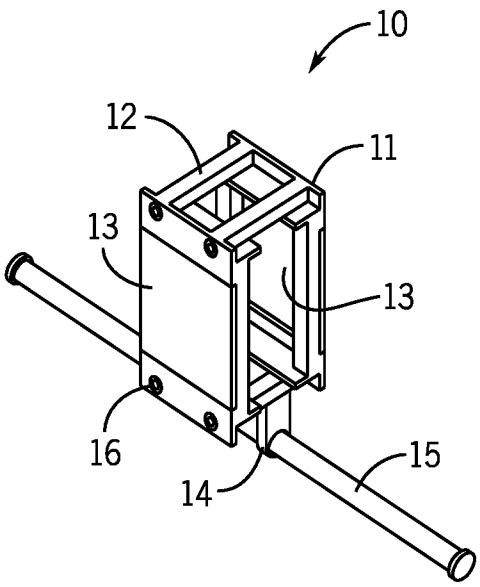
FIGS. 4*a* and 4*b* are two perspective views of the connection means of the exercise apparatus.
Figure 4A:
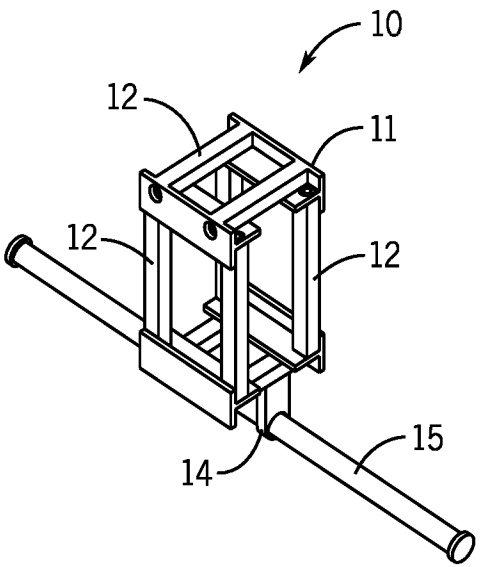

In one implementation, the trestle element 11 in turn comprises a plurality of element pieces 12 fastened to one another by means of screws or similar (FIG. 4*a*).

In another implementation, the trestle element 11 comprises a pair of plates 13 arranged at the sides of the beam 4 and interconnected by element pieces 12 fastened by means of screws or similar fasteners (FIG. 4*b*).

In the lower part said trestle element 11 is provided with at least one slot 14 in which it is possible to insert a rod 15 to hang elastic bands, ropes, straps or similar.

With reference to the figures from 5 to 8 a multifunction exercise apparatus 100 is illustrated, produced using said modular structure 1.

In detail said exercise apparatus 100 comprises at least two modular structures 1 positioned side by side in a direction Y parallel to the walls of the room.

According to the innovation the exercise apparatus 100 can be used by several persons simultaneously, each one having his/her own dedicated space in which to perform the exercises. In particular the space available to each person corresponds to a work area A, or to a portion of the floor surface of the room, defined by the position of the trestle elements 11 on the beams 4 of two consecutive modular structures 1.

In detail, according to a first embodiment, said area A comprises a quadrilateral, the vertexes of which are on the vertical projection of the locking means 10, or the trestle elements 11.

The distance between the consecutive modular structures is decided in the installation phase, but the apparatus can be easily reconfigured by varying the position of the columns on the floor.

A distance of approximately 1.5 meters between two adjacent modular structures guarantees good freedom of movement for each person to perform a wide range of exercises.

According to the innovation the connection means 10 are configured so as to slide on the beam 4 to vary the position on it.

For example, a person can simply loosen the connection screws of the element pieces 12 or of the plates 13 to release the grip on the surface of the beam and to translate the trestle element 11 along the axis X of the beam.

In this way it is possible to vary the surface of each work area A to adapt it to the type of exercise.

Preferably said connection screws 16 of the element pieces 12 and the plates 13 of the trestle elements 11 are provided with knobs or similar (not illustrated in the figure) to allow rapid tightening and release thus facilitating the reconfiguration operations by the staff of the gymnasium or the centre.

The number of modular structures 1 which the exercise apparatus 100 can comprise depends on the size of the room in which it is installed and the distance at which the various modular structures are positioned; more specifically, the number of modular structures which the multifunction exercise apparatus can comprise is practically unlimited.

According to the innovation the modular structure is configured for the connection of further pieces of exercise apparatus illustrated by way of example in the figures from 5 to 8.

Said apparatus can be positioned between two beams or between two adjacent columns, and connected to them in a fixed manner or with the possibility of relative movement (for example with hinges and similar).

For example, suspension bars 20 can be provided hinged on said trestle elements 11 with the possibility of translating from a rest position, in which they are substantially parallel to the beams 4, to a substantially vertical operating position.

Furthermore, bars 21 of various forms can be fixed between two facing beams to perform various exercises such as traction, stretching or similar, or further bars 22 for the connection of elastic bands, ropes and similar.

Figure 5:
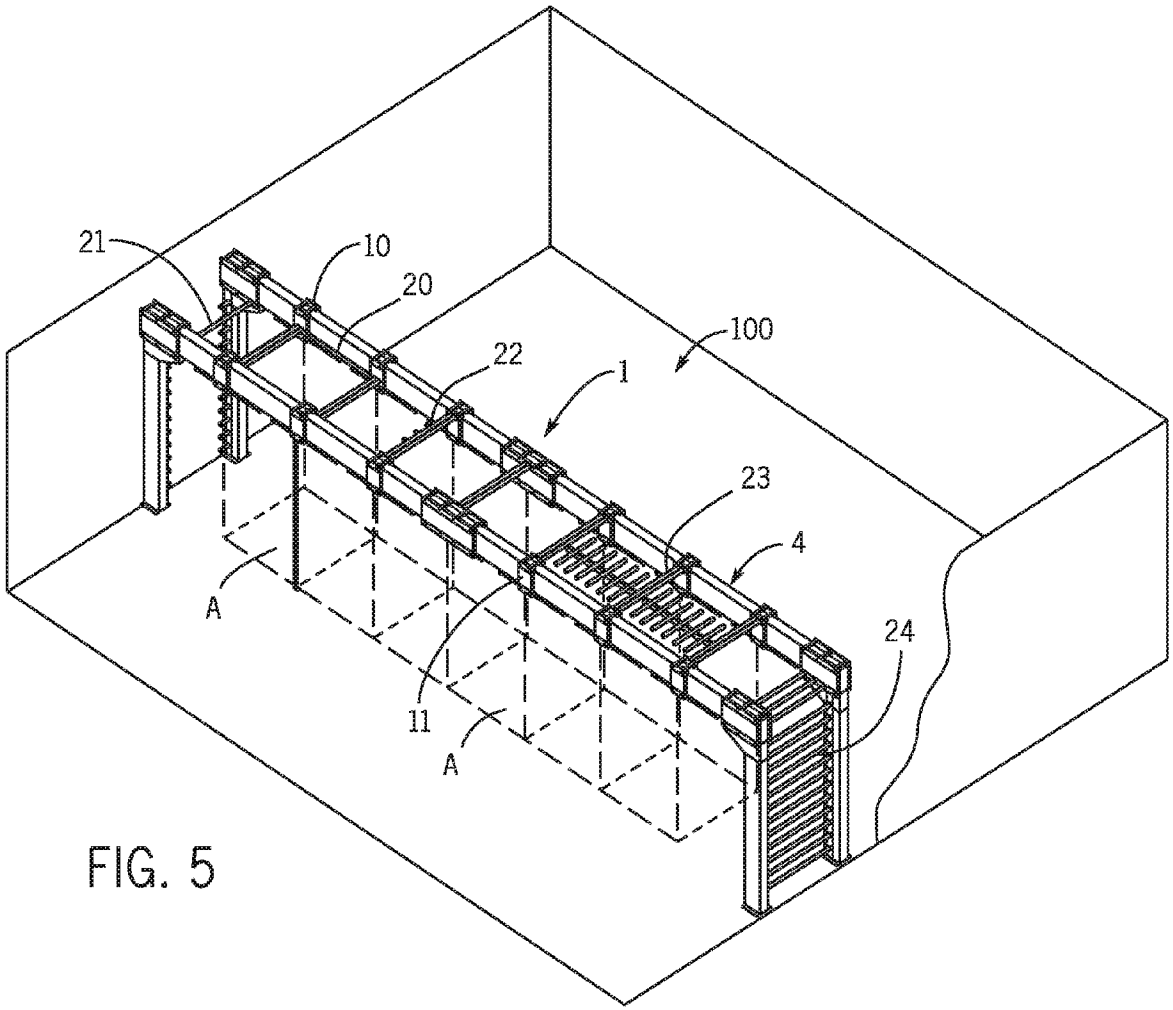
FIGS. 5 to 8 are perspective views of an exercise apparatus comprising a plurality of said modular structures of FIG. 1.
Figure 6:
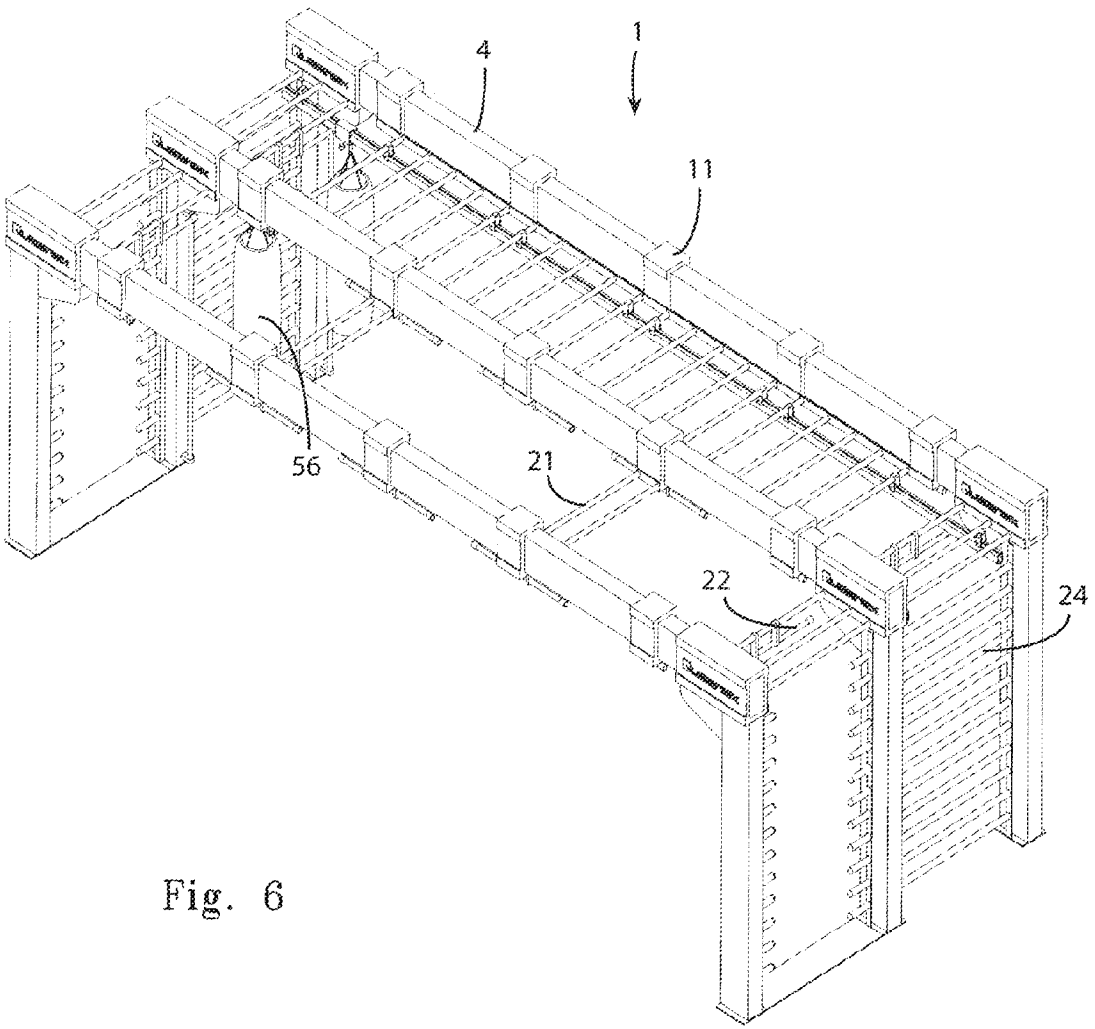
Figure 7:
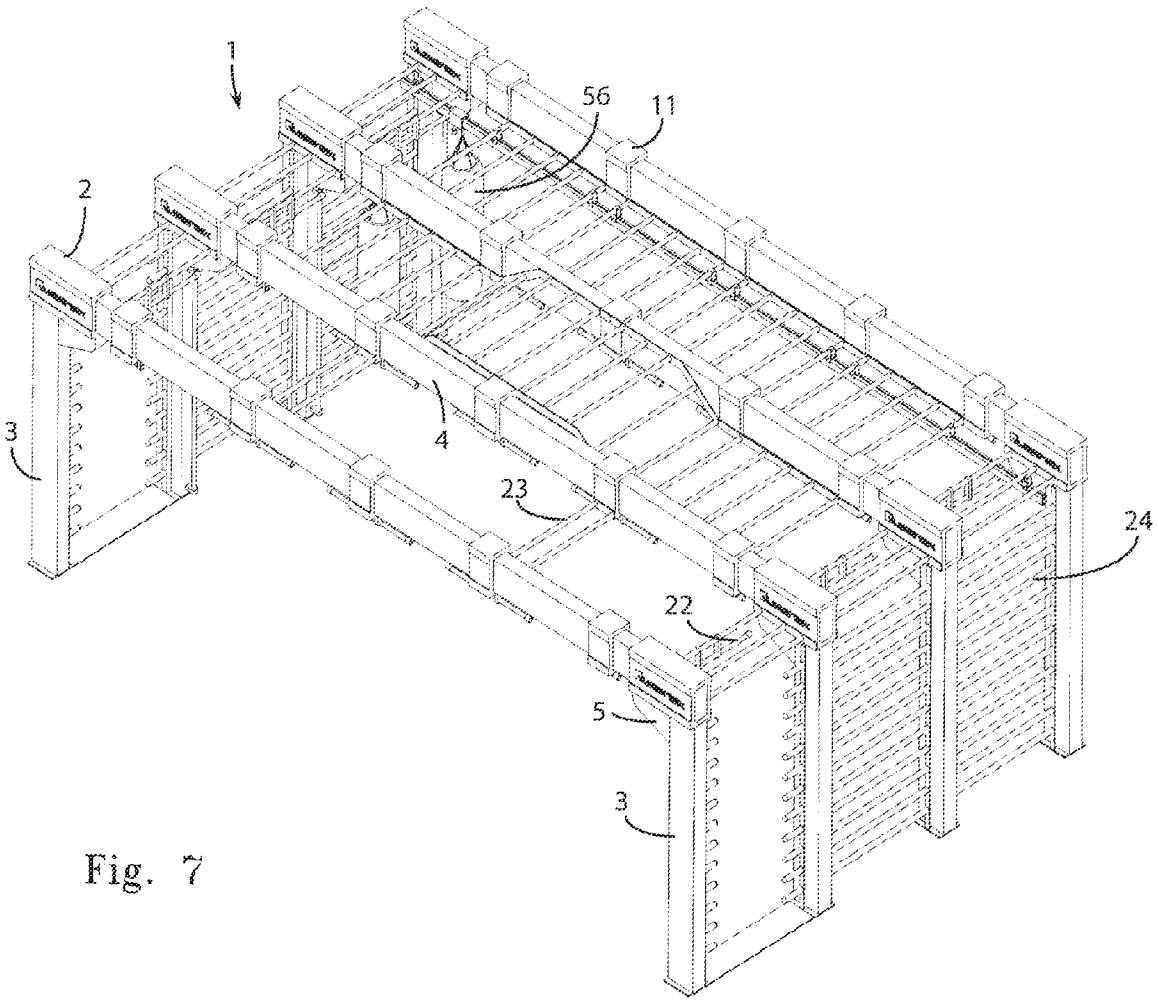
Figure 8:
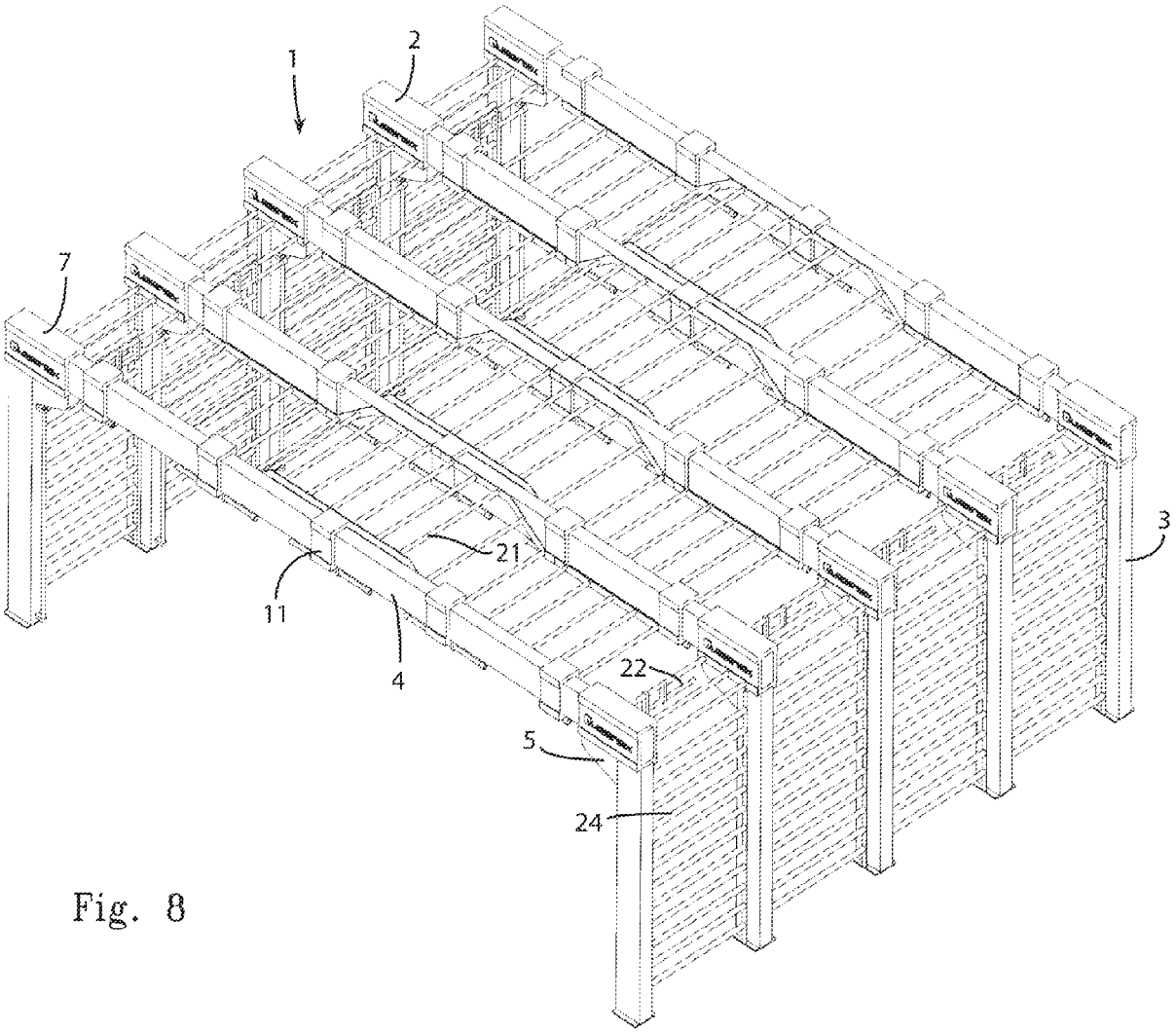

Again between said two trestle elements 11, supporting rods 23 can be provided for the connection of further equipment (FIG. 5).

The same, or further, equipment or accessories can also be positioned between two adjacent columns 3 so as to exploit also the surface of the walls as an equipped area without occupying the floor surface.

For example wall bars 24 or frameworks can be provided to contain or support various equipment (FIG. 5).

The above equipment is connected by quick release devices (joints or similar) so that they can be replaced rapidly and simply.

Figure 9:
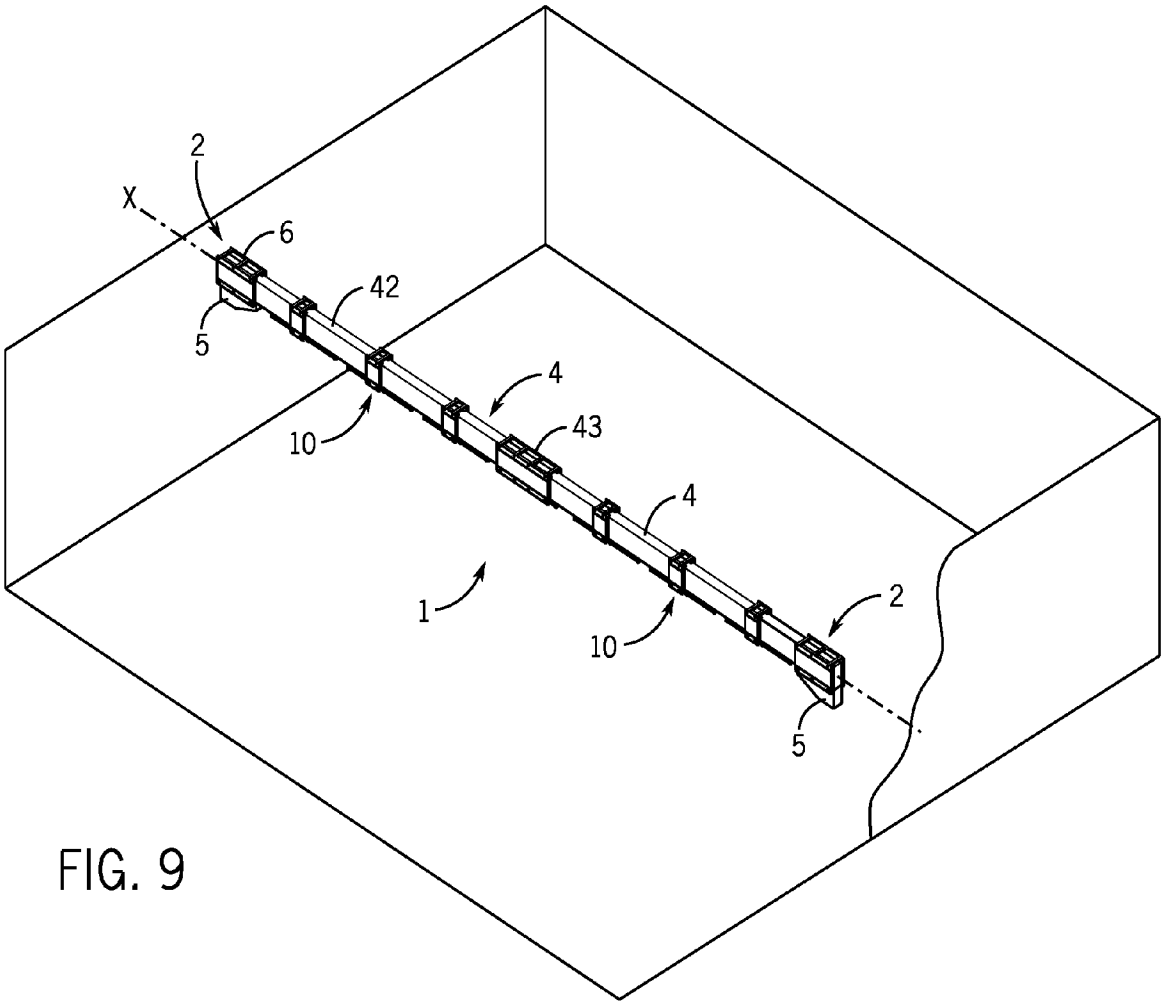
FIG. 9 is a perspective view of the modular structure for gymnasiums, according to a second embodiment of the innovation.

With reference to FIG. 9 a second embodiment of the innovation is illustrated.

In detail, the supports 2 are provided with means (not illustrated in the figure) for connection to the walls of the gymnasium or similar.

Also in this case it is possible to adapt the modular structure to the dimensions of the room by translating the beam 4 between the position of maximum support and minimum support with respect to the brackets 5 of the supports 2.

With reference to the figures from 10*a* to 10*c* a beam 30 is illustrated for the modular structure, according to an alternative embodiment.

In detail, said beam comprises at least two overlapped elongated members 31 and 32 kept together at a certain distance by a plurality of cores 33.

Figure 10A:
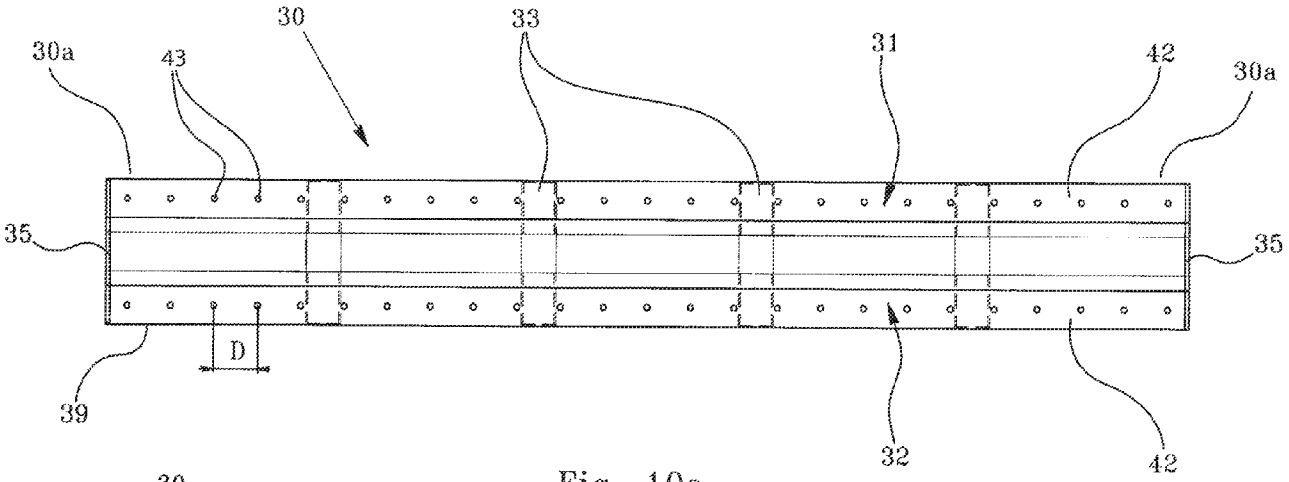
FIGS. 10*a* and 10*b* and 10*c* are respectively a front view, a section view and a lateral view of a beam of the modular structure according to another embodiment.
Figure 10C:
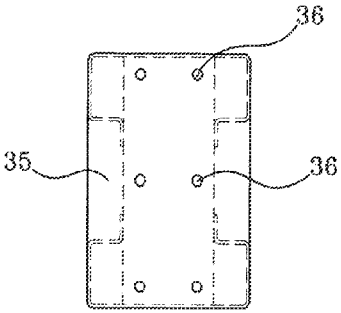
Figure 10B:
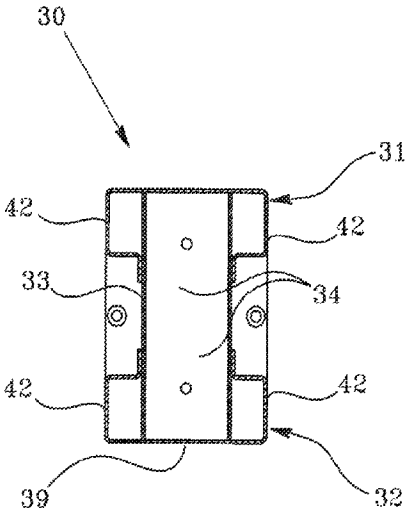

Preferably said elongated members 31 and 32 have a substantially C-shaped section and are open on at least one side 34 (FIG. 10*b*).

At each end 30*a* of the beam a plate 35 is provided, which acts as a coupling element, provided with a plurality of holes 36 suitable for housing the same number of bolts for connection to a plate 35 of another portion of adjacent beam (FIG. 10*c*).

The beam configured in this way is extremely lightweight, while at the same time having a high rigidity and load capacity, facilitating both transport and installation operations.

Since it is produced by the coupling of steel plates 35 and/or elongated members 31 and 32, standardised if necessary, the beam is also relatively simple to construct and therefore inexpensive.

The empty space remaining between the two elongated members 31 and 32 can also be exploited for the connection of further equipment, for example pulleys or similar (not illustrated in the figure) or as a storage space for equipment not being used at the time, so that the floor is always clear.

Figure 11:
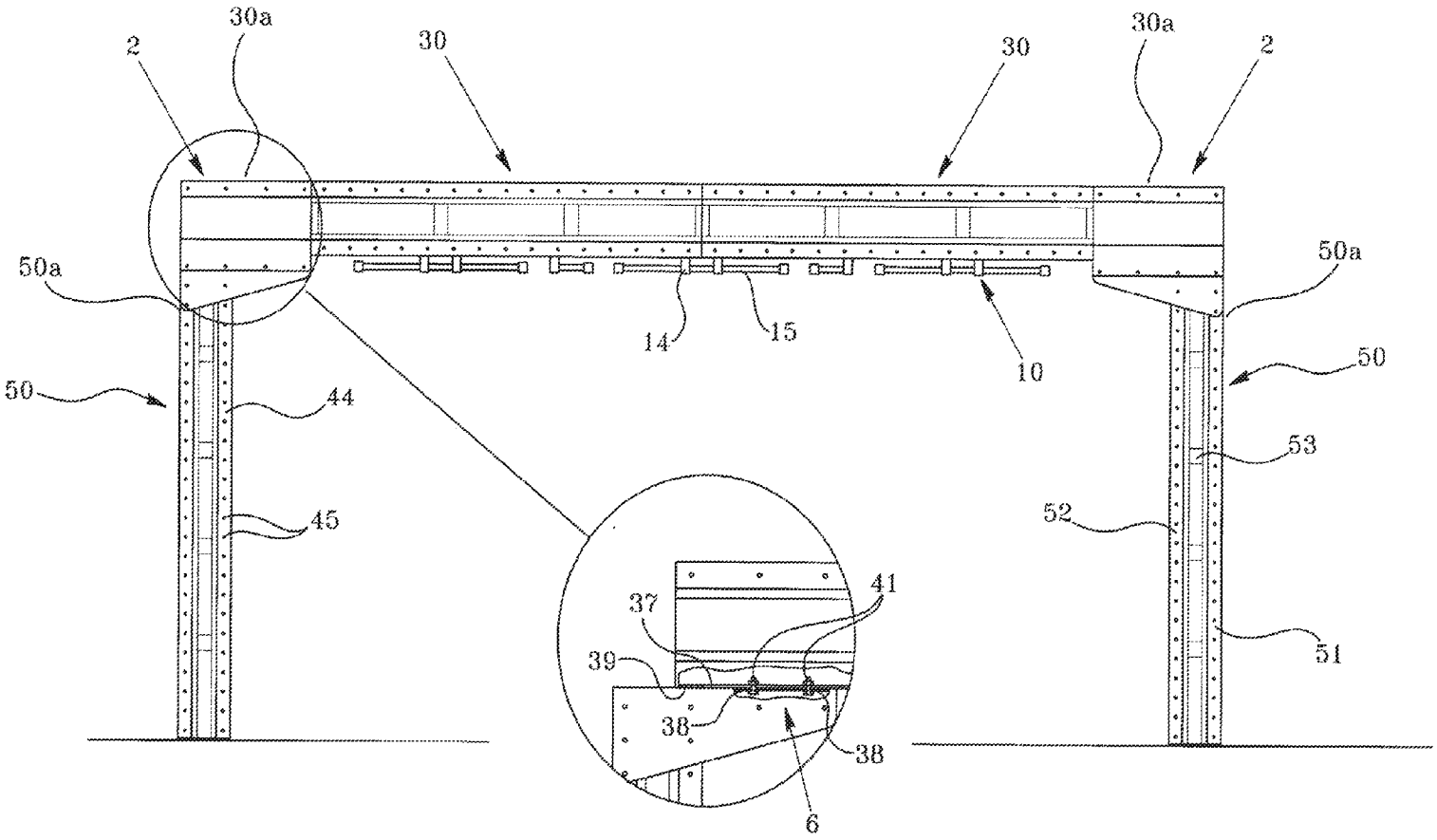
FIG. 11 is a front view of a modular structure provided with the beam of FIG. 10.

According to said alternative embodiment the connection means 6 for connection of the beam 30 to the supports 2 comprise a first slot 37, obtained on a lower face 39 of the lower elongated member 32 and arranged parallel to the axis X of the beam, and one or more holes 38, obtained on the bracket 5 suitable for housing bolts 40 or similar locking means (FIG. 11).

Figure 3A:
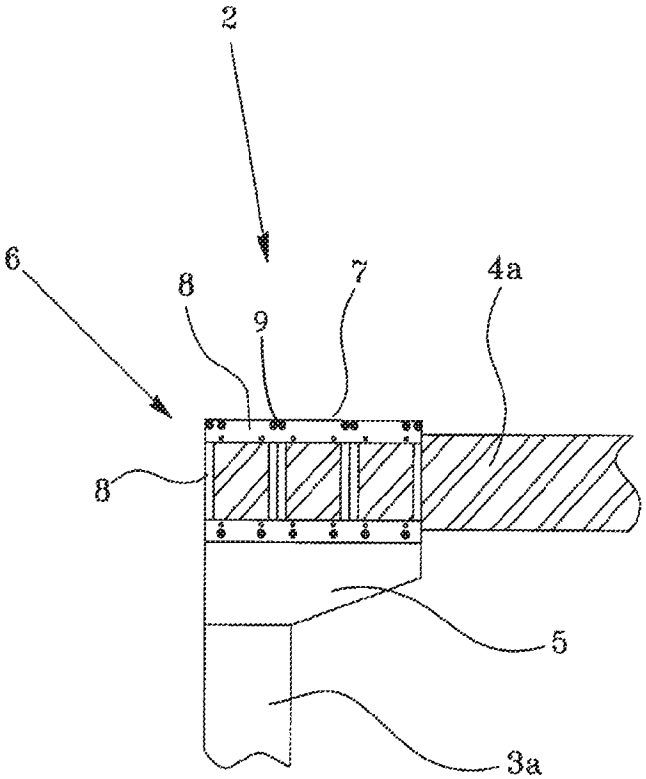

Said slot 37 allows the end 30*a* of the beam 30 to be secured on the bracket 5 both in the position of maximum support and in the position of minimum support, as illustrated in FIGS. 3*a* and 3*b*.

As for the first embodiment, during assembly of the modular structure the bolts 41 are released to allow exact positioning of the beam 30 with respect to the bracket 5.

Once the beam has been correctly positioned on the two supports 2, the bolts 41 are tightened to make the beam 30 integral with said supports.

In this embodiment illustrated, the connection means 10 of the exercise apparatus comprise one or more slots 14, fixed directly on the lower face 39 of the lower elongated member 32, in which it is possible to insert the rod 15 for the connection of elastic bands, ropes, straps or similar (FIG. 11)

According to the invention, the beam 30 is furthermore provided with a plurality of holes 43 obtained on the lateral faces 42 of at least one of the elongated members 31 and 32.

Said holes 43 are positioned at a pre-set distance D and act as connection means for further equipment such as the bars 21 and 22 positioned between adjacent beams or for the connection of flanges for supporting fit box punching bags, poles, etc.

Preferably also the columns 50 can be produced according to the same principle as the beam 30, or comprising at least two elongated column members 51 and 52 joined by a plurality of cores 53.

Also the columns 50 can have a plurality of holes 55, spaced from one another by a length D, obtained on the lateral faces 54 of the elongated column members 51 and 52 for connection of the various pieces of equipment.

Figure 12B:
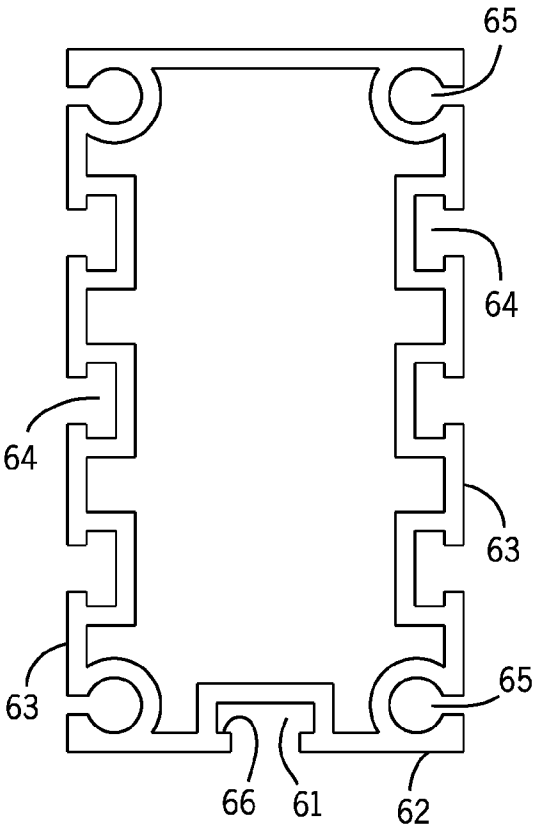
FIGS. 12*a* and 12*b* are respectively a front view and a section view of a beam of the modular structure according to a further embodiment.
Figure 12A:
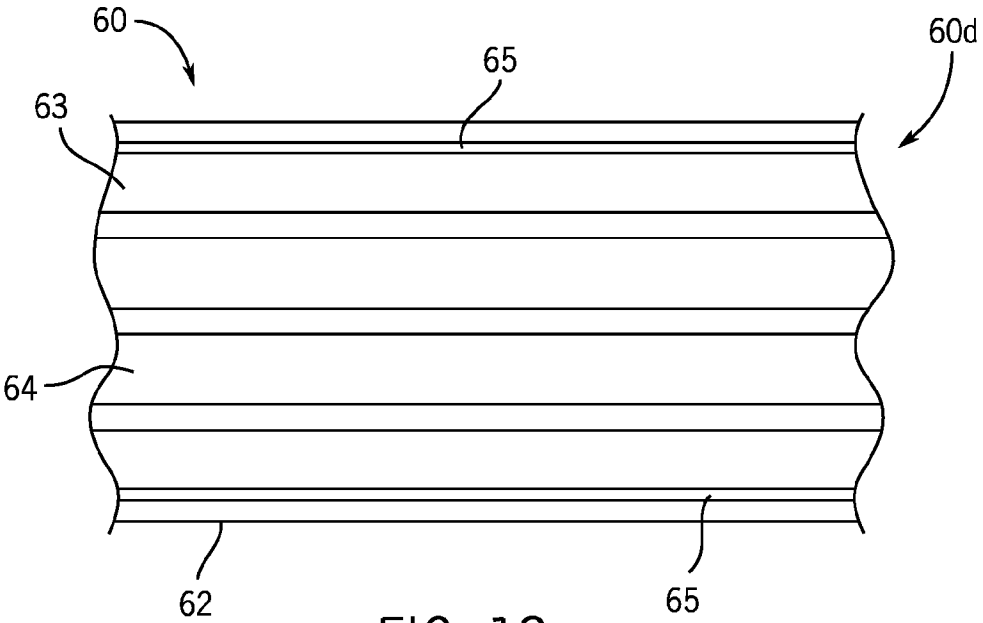

With reference to the FIGS. 12*a* and 12*b* a beam 60 is illustrated according to a further embodiment.

In detail, the beam comprises at least one extruded hollow element with constant sectional area, made preferably of aluminium or other alloys suitable for extrusion.

According to this further embodiment the connection means 6 for connection of the beam 60 to the supports 2 comprise a first groove 61, obtained on a lower face 62 of the extruded hollow element and arranged parallel to the X axis of the beam, and one or more holes 38, obtained on the bracket 5 (as in FIG. 11).

Preferably said groove 61 has a profile with an undercut 66 which allows one or more slidable fastening elements, such as, slides or cursors to be housed (not illustrated in the figure) which form an integral part of screw fastening elements of the beam on the supports 2 or are suitable for housing said screw fastening elements (bolts or similar).

The custom assembly of the beam and the positioning of the ends 60*a* on the supports 2 is performed practically identically to the procedure already described for the preceding embodiment.

Similarly also the connection means 10 of the exercise apparatus are fixed directly on said lower face 62 by means of screw fastening means housed in the groove 62 which extends preferably throughout the length of the beam.

Preferably said beam is provided with further grooves 64 obtained on at least one lateral face 63 suitable for one or more slidable fastening elements, such as, slides; or cursors for the connection of further exercise equipment such as suspension bars 20, bars 21 for performing various exercises such as traction, stretching or similar, or bars 22 for the connection of elastic bands, ropes and similar and supporting rods 23 for the connection of further equipment (FIG. 5).

The beam configured as above allows simplification of the construction as the extruded hollow element does not require further structural work before being installed.

Due to the fact that the various pieces of exercise equipment can be fixed by means of cursors that move along the grooves 61 and 64, the modular structure is even more flexible as both the dimension of the user work areas A and of the equipment installed can be varied simply and rapidly.

Since the beam extruded element is hollow, it also allows the coupling of several adjacent extruded elements, to reach the desired beam length, inserting inserts with a profile complementary to the internal profile of the beam, for a certain distance, in the two ends of two adjacent beams to be connected.

In this way no other locking means, bolts or similar are necessary, thus further speeding up the installation operations.

Preferably the beam comprises further grooves 65, obtained on said lateral faces 63, suitable for housing the edge of a panel or similar.

In this way between two beams of two adjacent modular structures it is possible to insert one or more panels acting as a false ceiling.

Said panels can also be customised with drawings or wording functional to execution of the gym exercises.

Thanks to the present innovation it is therefore possible to produce a multifunction exercise apparatus that can be configured for a wide range of activities without reducing the space available on the floor of the room.

The modular structure can also be installed rapidly and simply without the need for highly skilled personnel and without the construction of masonry work.

The present innovation, as described and illustrated, is subject to numerous modifications and variations all falling within the scope of the inventive concept; furthermore, all the details can be replaced by other technically equivalent elements.

What is claimed is:

1. At least one modular structure for a gymnasium or similar facility having a room with at least two facing walls, comprising:

at least one pair of support assemblies for positioning near the facing walls of the room;

a horizontally-positioned beam coupled at its ends to the support assemblies, the support assemblies being provided with a support connection means positionable between a tightened position in which the beam is fixed with respect to the support assemblies and a released position in which the beam is free to translate with respect to the support assemblies, the support connection means being sized to allow for the end of the beam to be fixed in at least two separate translational positions with respect to the support assembly; and a beam connection means for exercise apparatus being provided on the beam, the beam connection means being configured to translate along the beam.

2. The at least one modular structure of claim 1, wherein the at least one modular structure comprises at least two modular structures, as claimed in claim 1.

3. The at least one modular structure of claim 2, further comprising one or more pieces of exercise equipment positioned between two beams or between two facing columns of two adjacent modular structures.

4. The at least one modular structure of claim 2, further comprising one or more pieces of exercise equipment coupled in a removable manner to the beam by one or more quick release devices.

5. The modular structure of claim 1, wherein the support assemblies are provided with a plurality of fasteners for fixing to the walls of the room.

6. The modular structure of claim 1, wherein the pair of support assemblies include at least two columns configured for fixing the modular structure to the floor of the room, the support assemblies being connected in an integral manner to the upper ends of the columns.

7. The modular structure of claim 1, wherein the support assemblies comprise a bracket, the beam being able to translate with respect to the bracket from a position of maximum support, in which the end of the beam completely overlaps the bracket, to a position of minimum support, in which the beam overlaps a portion of the bracket.

8. The modular structure of claim 7, wherein the connection means comprise a trestle structure fixed in an integral manner to the bracket, the trestle structure comprising a plurality of interconnected structural pieces.

9. The modular structure of claim 7, wherein the beam comprises at least two overlapped elongated members kept together at a certain distance by a plurality of cores.

10. The modular structure of claim 9, wherein at each end of the beam, an end plate is fitted, provided with a plurality of holes suitable for housing a plurality of fasteners for connection of the plate to the beam.

11. The modular structure of claim 9, wherein the bracket includes a first slot for receiving a lower face of the lower elongated member and arranged parallel to the axis of the beam, and wherein one or more holes are positioned on the bracket, suitable for housing a plurality of fasteners.

12. The modular structure of claim 9 a plurality of holes are provided on at least one lateral face of at least one of the elongated members, wherein the holes are positioned at a pre-set distance (D), and wherein the holes enable the connection of one or more pieces of exercise equipment to the at least one elongated member.

13. The modular structure of claim 12 further comprising one or more pieces of exercise equipment, which is connected to the holes positioned on the beam.

14. The modular structure of claim 7, wherein the beam comprises at least one extruded hollow section element having a constant cross-sectional area, the extruded hollow section element including at least a first groove suitable for housing one or more slidable fastening elements.

15. The modular structure of claim 14, wherein the beam is provided with at least first and second grooves for the receiving one or more pieces of exercise equipment.

16. The modular structure of claim 1, wherein the beam connection means of the exercise apparatus comprise a trestle element positioned around the beam.

17. The modular structure of claim 16, wherein the trestle element includes a lower part with at least one slot for receiving one or more pieces of exercise equipment.

18. The modular structure of claim 1, wherein the beam connection means of the exercise apparatus comprises a trestle element positioned around the beam, and wherein the trestle element includes at least one pair of plates arranged in contact with two sides of the beam.

19. The modular structure of claim 1, wherein the beam includes two or more separate portions interconnected by one or more couplings.

20. The at least one modular structure of claim 1, wherein at least one of the supports includes a bracket, wherein the bracket includes a cantilevered portion, and wherein, in one of the translation positions, the end of beam is fixed only to the cantilevered portion of the bracket such that the end of the beam does not overlie the at least one support.

* * * * *